US007828278B2

(12) United States Patent
Tabuchi

(10) Patent No.: US 7,828,278 B2
(45) Date of Patent: Nov. 9, 2010

(54) INSERTER APPARATUS, PRINTER, PRINT SYSTEM AND INSERT METHOD

(75) Inventor: Hidehiro Tabuchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 362 days.

(21) Appl. No.: 12/051,990

(22) Filed: Mar. 20, 2008

(65) Prior Publication Data

US 2008/0230976 A1 Sep. 25, 2008

(30) Foreign Application Priority Data

Mar. 20, 2007 (JP) ..... 2007-072361

(51) Int. Cl.
*B65H 39/00* (2006.01)

(52) U.S. Cl. ..... 270/58.23; 270/58.02

(58) Field of Classification Search ..... 270/58.01, 270/58.02, 58.23, 58.25, 58.31
See application file for complete search history.

(56) References Cited

U.S. PATENT DOCUMENTS 3,490,761 A * 1/1970 Bell ..... 270/52.02
5,272,511 A * 12/1993 Conrad et al. ..... 399/382
5,489,969 A * 2/1996 Soler et al. ..... 399/18

FOREIGN PATENT DOCUMENTS

JP 2005-070078 A 3/2005

* cited by examiner

*Primary Examiner*—Leslie A Nicholson, III
(74) *Attorney, Agent, or Firm*—Westerman, Hattori, Daniels & Adrian, LLP

(57) ABSTRACT

An inserter apparatus has a printer A and an inserter apparatus B. The printer A has a print section 13, and an insert information output section 9 for outputting insert information including an insert page showing a position of an insert paper and an interval of printing papers. The inserter apparatus B has a discharged paper carrying section 17 of printing papers from the print section 13; a counter section 19 for counting the number of sheets of the printing papers; a paper feeding section 21 for setting the insert paper therein; and a paper feeding controller 23. Based on insert information from the insert information output section 9, the paper feeding controller 23 controls the insert paper to be fed at a timing before the next paper interval is passed after a count value of the counter section 19 reaches one page before the insert page. Therefore, it is possible to realize an excellent short insert processing for the printing papers.

4 Claims, 5 Drawing Sheets

INSERTER APPARATUS, PRINTER, PRINT SYSTEM AND INSERT METHOD

BACKGROUND

1. Field of the Invention

The present invention relates to an inserter apparatus, a printer, a print system and an insert method, and relates to an improvement in the inserter apparatus, the printer, the print system and the insert method used in, for example, a copying machine, and a facsimile machine or a multi function peripheral (MFP) of them.

2. Description of Related Art

In recent years, in the copying machine, the facsimile machine, and the multi function peripheral, etc, a structure of having a built-in inserter mechanism for automatically inserting inserter papers different from printed printing papers, between such printing papers in the middle of discharging the printing papers, or having an inserter apparatus connected to outside, is proposed.

For example, an image forming system and an inserter apparatus shown in Japanese Patent Laid Open No. 2005-70078 (patent document 1) has a kind of such a structure.

The patent document 1 has a structure of communicating a control command transmitted between an image forming apparatus and a post-processing apparatus via the inserter apparatus, in an image forming system in which the inserter apparatus and a post-processing apparatus are connected to the image forming apparatus. In this structure, the control command communicated between the image forming apparatus and the post-processing apparatus is transmitted via the inserter apparatus, thus making it possible to simplify a control system.

However, the aforementioned patent document 1 has a problem that a variation in a carrying distance from a paper feeding stage in which an unprinted paper is set, to the inserter, and further a variation in communication of the control signal transmitted between the image forming apparatus and the post-processing apparatus must be taken into consideration, for inserting and discharging the insert paper in a good state.

Therefore, a carrying interval between paper sheets fed from the paper feeding stage is made sufficiently larger than necessary and the paper sheet is thereby prevented from being jammed. Therefore, a print processing speed tends to drop.

Particularly, when the number of prints is increased, a period required for print is extremely prolonged. Therefore, improvement is desired.

SUMMARY OF THE INVENTION

In order to solve the above-described problem, the present invention is provided, and an object of the present invention is to provide an inserter apparatus, a printer, a print system and an insert method enabling a short and excellent insert processing to be performed and capable of shortening a period from start to completion of the print including insert processing.

In order to solve the above-described problem, the inserter apparatus according to the present invention includes:

a discharged paper carrying section that carries printing paper discharged from a print section side;

a counter section that counts the number of carried printing papers carried by the aforementioned discharged paper carrying section;

a paper feeding section in which an insert paper is set, the insert paper being inserted on the printing paper carried on a carrying path of the paper carrying section; and a paper feeding control section that controls the paper feeding section to feed the inset paper before the paper interval that comes next is passed by a period required for inserting and feeding the insert paper, based on insert pages and the paper interval between adjacent printing papers instructed from the print section side, when a count value of the counter section reaches one page before an insert page.

A printer according to the present invention includes:

a print section that discharges the printing paper on which printing is performed by executing a print job;

an insert information output section that outputs a start timing of the print job, the insert pages showing a position of inserting the insert paper in the middle of the printing papers, and the paper interval between the adjacent printing papers;

a discharged paper carrying section for carrying the printing paper discharged from the print section;

a counter section that counts the number of carried sheets of the printing papers carried by the discharged paper carrying section;

a paper feeding section in which the insert paper is set, the insert paper being inserted on the printing paper carried on a carrying path of the discharged paper carrying section; and a paper feeding control section that controls the paper feeding section to feed the inset paper before the paper interval that comes next is passed by a period required for inserting and feeding the insert paper, based on the insert pages and the paper interval between the adjacent printing papers instructed from the insert information output section, when a count value of the counter section reaches one page before an insert page.

Further, a print system according to the present invention includes such a printer and an inserter apparatus connected thereto.

According to the present invention, the printing paper may be carried, with a space of pages provided for inserting the insert paper.

According to the present invention, the print section may discharge the printing paper, with space provided for inserting the insert page.

According to the present invention, the counter section may start counting based on the aforementioned start timing.

According to the present invention, the discharged paper carrying section may be disposed in a front stage of the post-processing apparatus.

In the inserter apparatus, the printer and the print system according to the present invention, the printing paper on which printing is performed by executing the print job is discharged;

the discharged printing paper is carried;

the insert paper inserted on the printing paper during carrying processing is previously set;

the number of carried sheets of the carried printing papers is counted; and when the count value reaches before one page of the insert page, the insert paper is controlled to be fed before the paper interval that comes next is passed by a period required for feeding and inserting the insert paper, based on a prescribed insert page and the paper interval, then the insert paper is inserted on the carried printing paper.

Therefore, excellent and short insert processing is possible, and a period from the start to completion of printing including the insert processing can be shortened.

According to the present invention, the printing paper discharged from the print section side is discharged, with a space of pages provided for inserting the insert page, and therefore the inset paper can be inserted in a reliable and excellent state.

According to the present invention, the counter section starts to count based on the start timing, and therefore a reliable count for insert is possible.

According to the present invention, the discharged paper carrying section is disposed in the front stage of the post-processing apparatus, and therefore a processing period including the post-processing can be shortened.

DESCRIPTION OF PREFERRED EMBODIMENTS OF THE INVENTION

Preferred embodiments of the present invention will be explained, with reference to the drawings.

Figure 1:
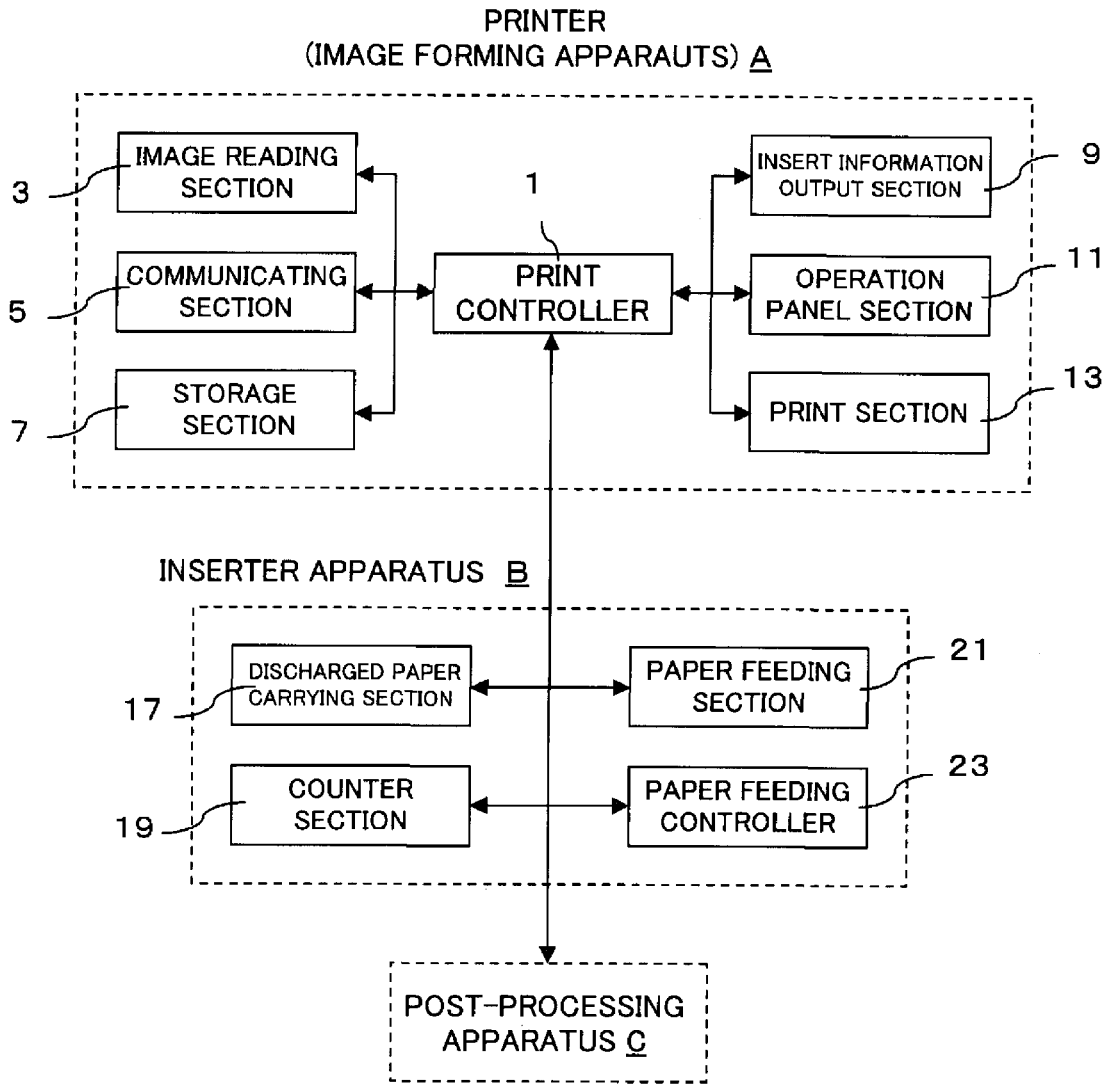
FIG. 1 is an outlined block diagram illustrating an embodiment of a print system including a printer and an inserter apparatus according to the present invention.

FIG. 1 is an outlined block diagram illustrating an embodiment of an inserter apparatus and a printer, and a print system including them according to the present invention. Note that an insert method according to the present invention will be explained in a process of explaining them.

In FIG. 1, a printer A according to the present invention includes an image reading section 3, a communicating section 5, a storage section 7, an insert information output section 9, an operation panel section 11, and a print section 13 connected to a print controller 1, with the print controller 1 as a center. The printer A is also connected to an inserter apparatus B and a post-processing apparatus C.

The print controller 1 controls the image reading section 3, the communicating section 5, the storage section 7, the insert information output section 9, the operation panel section 11, and the print section 13, and details will be described later.

Figure 2:
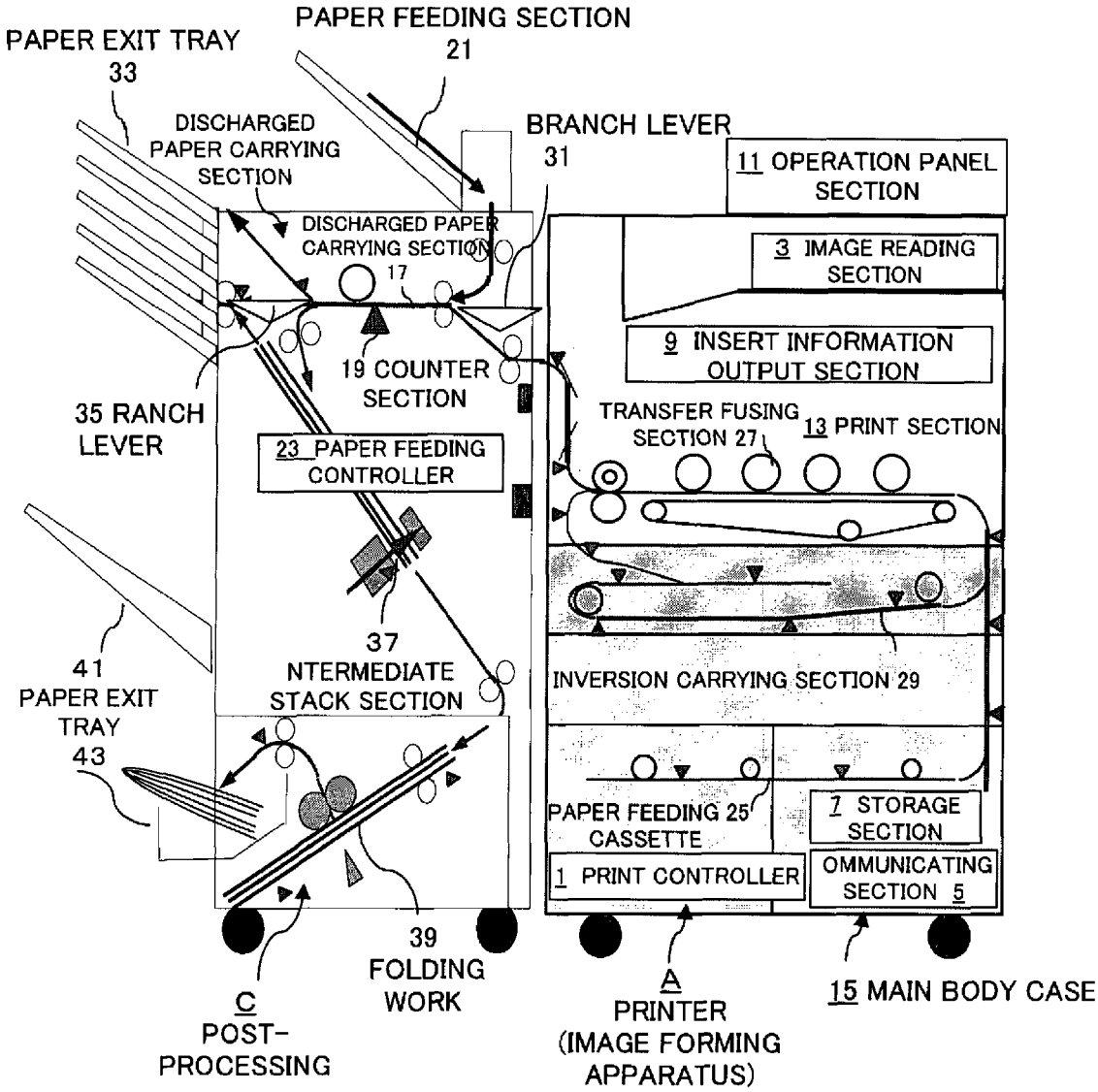
FIG. 2 is an outlined block diagram illustrating the print system of FIG. 1 together with the printer and the inserter apparatus.

For example, in the printer A of FIG. 2, the image reading section 3 is disposed in an upper part of a main body case 15. The image reading section 3 serves as a publicly-known scanner, etc, which for example, optically reads an image from a document of a printed plurality of pages, under a control of the print controller 1, and applies filter processing, magnification processing and tone processing to form electronic print data, which is created as a print job. The created print job is sequentially stored in the storage section 7 for each page of the document. An internal structure of the printer A shown in FIG. 2 will be described later.

The communicating section 5 serves as an interface section for, for example, making facsimile communication of print data by using a prescribed protocol via a network not shown. Note that regarding the facsimile communication, this is not an essential part of the present invention and therefore explanation therefore and the figure therefore are omitted.

The storage section 7 serves as, for example, a hard disc (HDD) for storing insert information and an operation program, etc, of the print controller 1 as will be describe later, in addition to the print data from the image reading section 3 and the communicating section 5.

Under the control of the print controller 1, the insert information output section 9 has a function of outputting a start timing of the print job, an insert page showing a position where the insert paper is inserted in the middle of a plurality of printing papers, and the interval between the discharged adjacent printing papers, which are called parameters.

The start timing of the print job is a start instruction of the print job in the printer A, and for example is a paper feeding timing for feeding the paper from a paper feeding cassette 25 as will be describe later. The insert pages are previously designated number of pages in the print job, showing page information regarding the page number (such as page 4) of the papers during carrying, where the insert paper is inserted. Paper interval (Y) of the printing papers is the information showing the interval between tip edges of the continuously discharged adjacent printing papers by a carrying speed such as 1000 msec.

The start timing of the print job is automatically outputted from the insert information output section 9, when the insert function is selected, and parameters such as insert page and paper interval (Y) are set, for example, from the operation panel section 11.

The operation panel section 11 is a liquid crystal operation panel, etc, serving also as a liquid crystal displayer and a touch switch input section, disposed in an upper part of the main body case 15 of the printer A of FIG. 2.

The operation panel section 11 has functions of selecting the paper, being a printing medium for print, execution or stop of printing operation, setting and input of the insert pages and the paper interval (Y), being the insert information regarding an insert processing function of the present invention, and other conventional publicly-known display input function, and is controlled by the print controller 1.

The print section 13 is disposed in the main body case 15 of the printer A of FIG. 2 and functions to print the print data on the carried paper sheet, so that black/white and color print are possible.

The print controller 1 has a CPU (Central Processing Unit), a memory section in which an operation program of the CPU is stored, and an input/output interface (both of them are not shown ), and controls the aforementioned image reading section 3, communicating section 5, storage section 7, insert information output section 9, operation panel section 11, and print section 13. The print controller 1 has a function of a part of the insert information output section 9.

Figure 3:
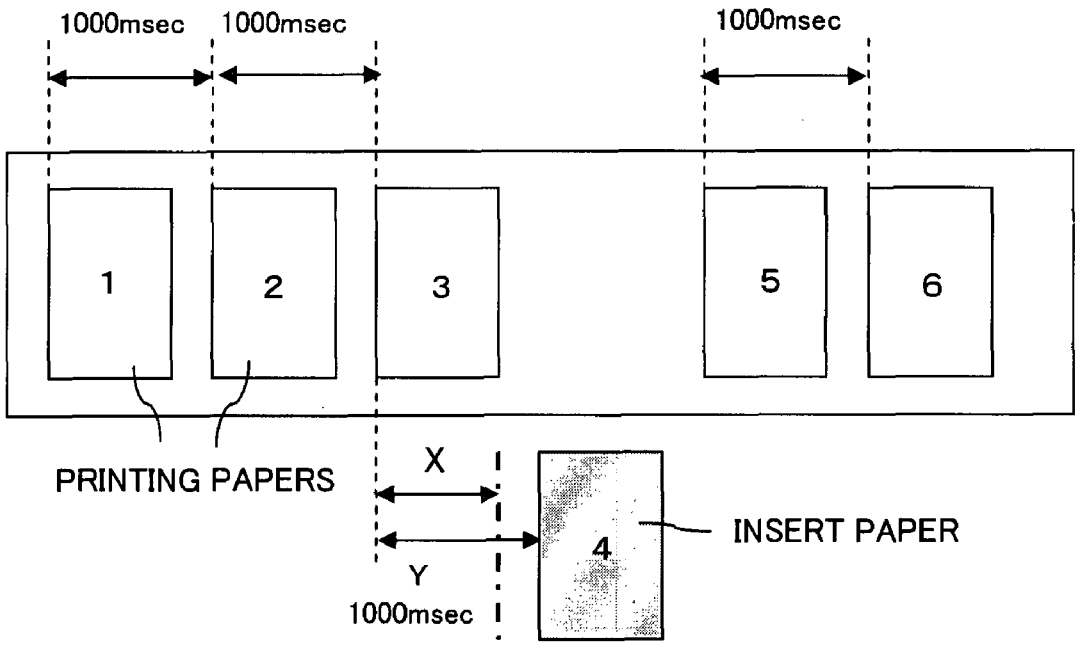
FIG. 3 is a view explaining insert processing of the present invention.

The print controller 1 controls the print section 13, etc, if the insert function is selected, and has a function of controlling the printed paper to be discharged, with a space of pages provided for inserting the insert paper. Namely, as is shown in FIG. 3, a space for inserting the insert paper is provided, to control carrying of the printed paper.

An inserter apparatus B is installed in conjunction with the printer A so as to be connected to the paper discharging section of the print section 13, and as is shown in FIG. 1, is formed by including a discharged paper carrying section 17, a counter section 19, a paper feeding section 21, and a paper feeding controller 23, and is electrically connected to the print controller 1 and the post-processing apparatus C. The inserter apparatus B is shown in FIG. 2 in a state of incorporating the post-processing apparatus C for convenience.

The discharged paper carrying section 17 is a path for receiving the discharged printed paper from the print section 13 and carrying this paper for insert, and the carrying of the discharged paper is controlled by the paper feeding controller 23.

The counter section 19 has a sensor for detecting the pass of the tip edge of each printed paper carried on this discharged paper carrying section 17, and has a function of starting to count the number of sheets for carrying based on the aforementioned start timing and outputting a count value to the paper feeding controller 23.

The insert paper, which is inserted on the printing paper carried on the discharged paper carrying section 17, is set in the paper feeding section 21, so that the insert paper is fed and carried to the discharged paper carrying section 17 at a paper feeding timing as will be described later.

A period after feeing the insert paper from the paper feeding section 21 until this insert paper is inserted by the discharged paper carrying section 17, is previously set by the paper feeding controller 25.

The paper feeing controller 25 has a memory section in which the operation program of this CPU is stored, and an input/output interface (both of them are not shown). The paper feeding controller 25 has a function of controlling the paper feeding section 21 to feed the paper based on the parameters such as start timing of the print job, insert pages, and the interval (Y) between adjacent printing papers instructed from the insert information output section 9, when the count value from the counter section 19 reaches one page before the insert page.

The paper feeding controller 25 has a function of controlling the paper feeding section 21 to feed the paper at a timing (X) before the paper interval (Y) that comes next is passed by a period required for feeding and inserting the insert paper, as the timing for feeding the insert paper from the paper feeding section 21.

Namely, as shown in FIG. 3, the paper feeding controller 25 starts to feed paper at the timing (X) earlier than the pass of the next paper interval (Y) by a period required for feeding the paper from the paper feeding section 21 and inserting it to the carrying path of the discharged paper carrying section 17, when the count value from the counter section 19 reaches one page before the insert page.

FIG. 2 is an outline view showing an internal structure of the aforementioned printer A, inserter apparatus B, and post-processing apparatus C.

In FIG. 2, the aforementioned print section 13 is disposed in a lower part of the main body case 15 of the print apparatus A. The print section 13 is composed of the paper feeding cassette 25 and a transfer fusing section 27 for transferring and fixing an image of the print data while secondary-feeding the unprinted paper which is primarily-fed from the paper feeding cassette 25.

Note that a designation mark 29 in FIG. 2 indicates an inversion carrying section for reversing front and rear of the printing paper, with the image transferred and fixed on one surface, and returning this printing paper to the transfer fusing section 27.

The aforementioned image reading section 3 and the operation panel section 11 are disposed in an upper part of the main body case 15. The print controller 1, the communicating section 5, the storage section 7, and the insert information output section 9 are disposed at an appropriate position inside of the main body case 15 so as to form an electronic circuit.

The aforementioned inserter apparatus B and post-processing apparatus C are disposed in conjunction with each other on the paper discharging section side of the print section 13.

The inserter apparatus B has the paper carrying section 17 for carrying the printing paper discharged from the print section 13; the counter section 19 for detecting and counting the tip edge of the printing paper; the paper feeding section 21 for feeding the previously set insert paper; the paper feeding controller 23 for controlling to feed the insert paper; and a branch lever 31 for branching the printing paper from the print section 13 and the insert paper from the paper feeding section 21, based on a control of the paper feeding controller 23.

The post-processing apparatus C has a paper exit tray 33 for accumulating the printing papers discharged from the inserter apparatus B; a branch lever 35; an intermediate stack section 37; and a folding work section 39.

Designation marks 41 and 43 in the post-processing apparatus C indicate the paper exit tray for the printing paper from the intermediate stack section 37 and the folding work section 39.

Next, an operation of a print apparatus system of the present invention will be explained.

As an example, as shown in FIG. 3, explanation will be given for a case that the insert paper with different color from the color of the printing paper is inserted on page 4 of the printing paper carried at a speed interval of 1000 msec.

When the insert print instruction is given, the print controller 1 controls the paper feeding cassette 25. Therefore, the paper sheet is carried from the paper feeding cassette 25 to the print section 13 and is printed in color or black and white, and is discharged.

Based on an insert print instruction, the insert information output section 9 outputs information regarding the start timing of the print job, and insert information such as insert page and paper interval (Y).

Figure 4:
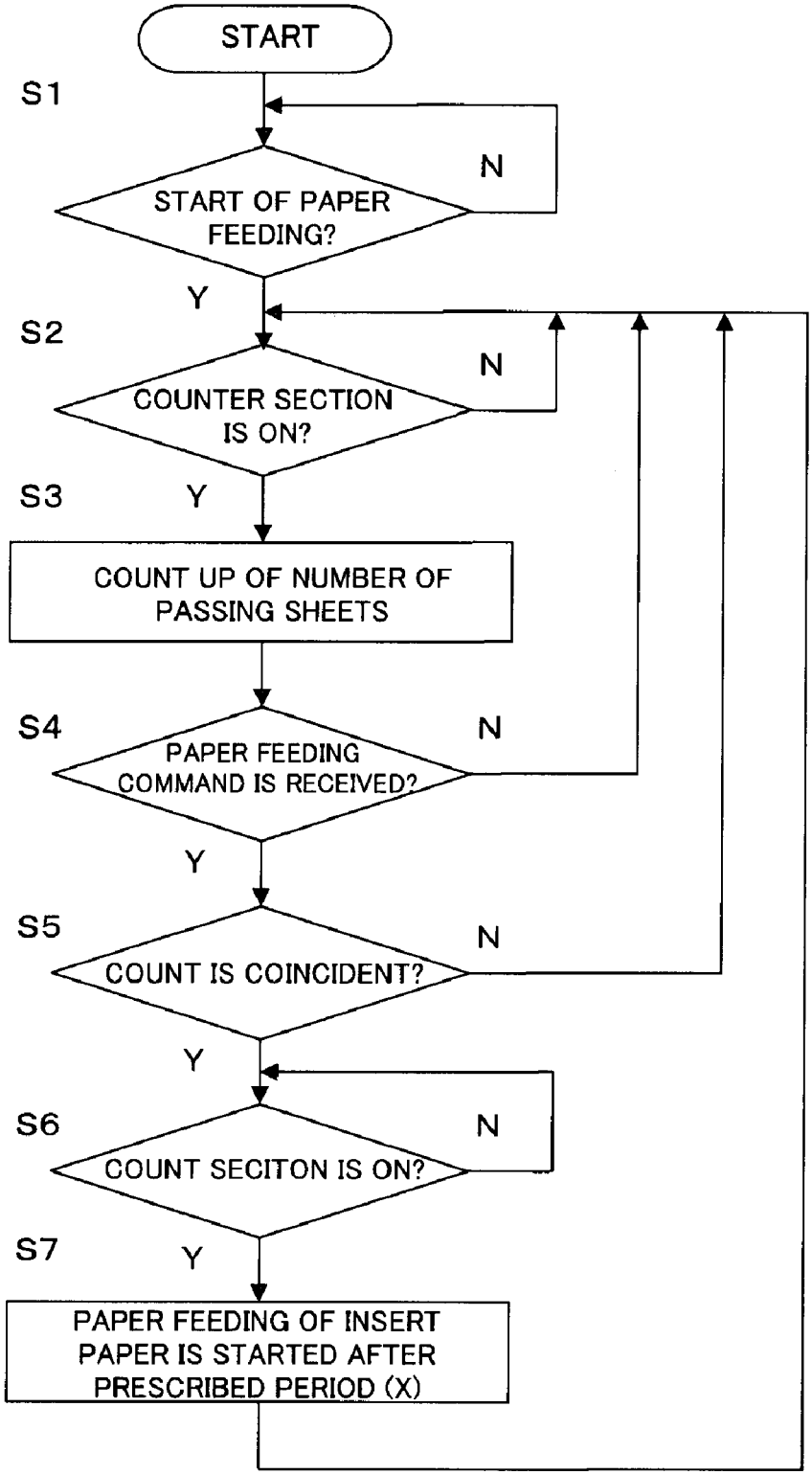
FIG. 4 is a flowchart explaining the insert processing of the present invention.

Responding thereto, the insert apparatus B is operated as shown in the flowchart of FIG. 4, for example.

The paper feeding controller 23 waits for a start of feeing paper as shown in step S1. When paper feeding is started, in step S2, whether or not the counter section 19 detects the printing paper is determined and the processing of step S2 is repeated until the printing paper is discriminated.

When the printing paper is detected and YES in step S2, the counter section 19 counts up the number of passing sheets of printing papers, and the processing is moved to step S4. In step S4, the paper feeding controller 23 determines existence/non-existence of receiving interval information (paper feeding command) of the printing papers.

When the paper feeding command is not received and NO in step S4, the processing is returned to step S2, and when it is received and YES in step S4, the processing is moved to step S5.

In step S5, the paper feeding controller 23 determines whether or not the count value is coincident to a set value (one page before the insert page).

When the count value does not reach the set value and is not coincident thereto, step S5 shows NO and the processing is returned to step S2. When the count value is coincident to the set value and YES in step S5, the counter section 19 determines the existence/non-existence of the tip edge of the printing paper of the insert page.

Step S6 is the step of detecting the paper feeding timing of the insert page.

When the tip edge of the printing paper of one page before the insert page is not detected and NO in step S6, the processing of step S6 is repeated until it is detected. When the tip edge of the printing paper of one page before is detected and YES in step S6, the paper feeding controller 23 performs start processing of the paper feeding section 21 after a period (X)

from the timing when the tip edge of the printing paper of one page before is detected, and the processing is returned to step S2.

Thus, the insert paper is inserted on page 4. When there are a plurality of insert places, the aforementioned step is repeated.

Thereafter, the printing paper is sent to the paper exit tray 33, carried to the intermediate stack section 37 to be subjected to staple processing, or carried to the folding work section 39 to be subjected to post-processing such as folding. The printing paper thus subjected to post-processing is discharged to the paper exit trays 41 and 43.

These processing corresponds to the insert method of the present invention.

Thus, the print system according to the present invention is formed of the printer A and the inserter apparatus B connected thereto.

Then, the printer A includes the print section 13 for discharging the printing paper, with the image printed on the paper by executing the print job, and the insert information output section 9 for outputting the insert page showing the position where the insert paper is inserted in the middle of printing paper, and the paper interval (Y) of the adjacent printing papers.

In addition, the inserter apparatus B includes the discharged paper carrying section 17 for carrying the printing paper discharged from the print section 13; the counter section 19 for counting the number of sheets of the printing papers carried on the carrying path of the discharged paper carrying section 17; the paper feeding section 21 in which the insert paper is set, the insert paper being inserted on the printing paper carried on the carrying path of the discharged paper carrying section 17; and the paper feeding controller 23 for controlling the paper feeding section 21 to feed the insert paper based on the insert page and the paper interval (Y) of the adjacent printing papers instructed from the insert information output section, before the paper interval (Y) that comes next is passed by a period required for insert such as feeding the insert paper, when the count value of the counter section 19 reaches one page before the insert page.

Therefore, an optimal control is possible without broadening the interval more than necessary between papers positioned before/after the insert paper, thus improving an insert processing efficiency.

In addition, an insert processing control of the insert paper is performed by the counter section 21 and the paper feeding controller 23 in the inserter apparatus B. Therefore, generation of a trouble such as a continuance jam, etc, due to a variation in carrying the printing paper and a variation in transmitting time of the information between the printer A and the inserter apparatus B can be suppressed, thus allowing an excellent insert processing to be performed and reliability is improved.

Further, the discharged paper carrying section 17 carries the printing paper, with a space of pages provided for inserting the insert paper, thus allowing the insert paper to be inserted in a good state.

In addition, the counter section 19 starts to count based on print start information, thus allowing a correct count of the printing paper to be performed and the insert paper can be correctly inserted on a target insert page.

Further, even when the post-processing is executed, it is possible to shorten a period for completing the print processing including the post-processing.

Incidentally, the aforementioned structure is directed to the print system including the printer A and the inserter apparatus B. However, the present invention can be constituted, so that the aforementioned inserter apparatus B is independently formed, including the discharged paper carrying section 17, the counter section 19, the paper feeding section 21 and the paper feeding controller 23, thus making it possible to perform an optimal control of the paper interval (Y) between back and forth of the insert paper, thus exhibiting an advantage of improving the insert processing efficiency. The same thing can be said for the insert method of the present invention.

Figure 5:
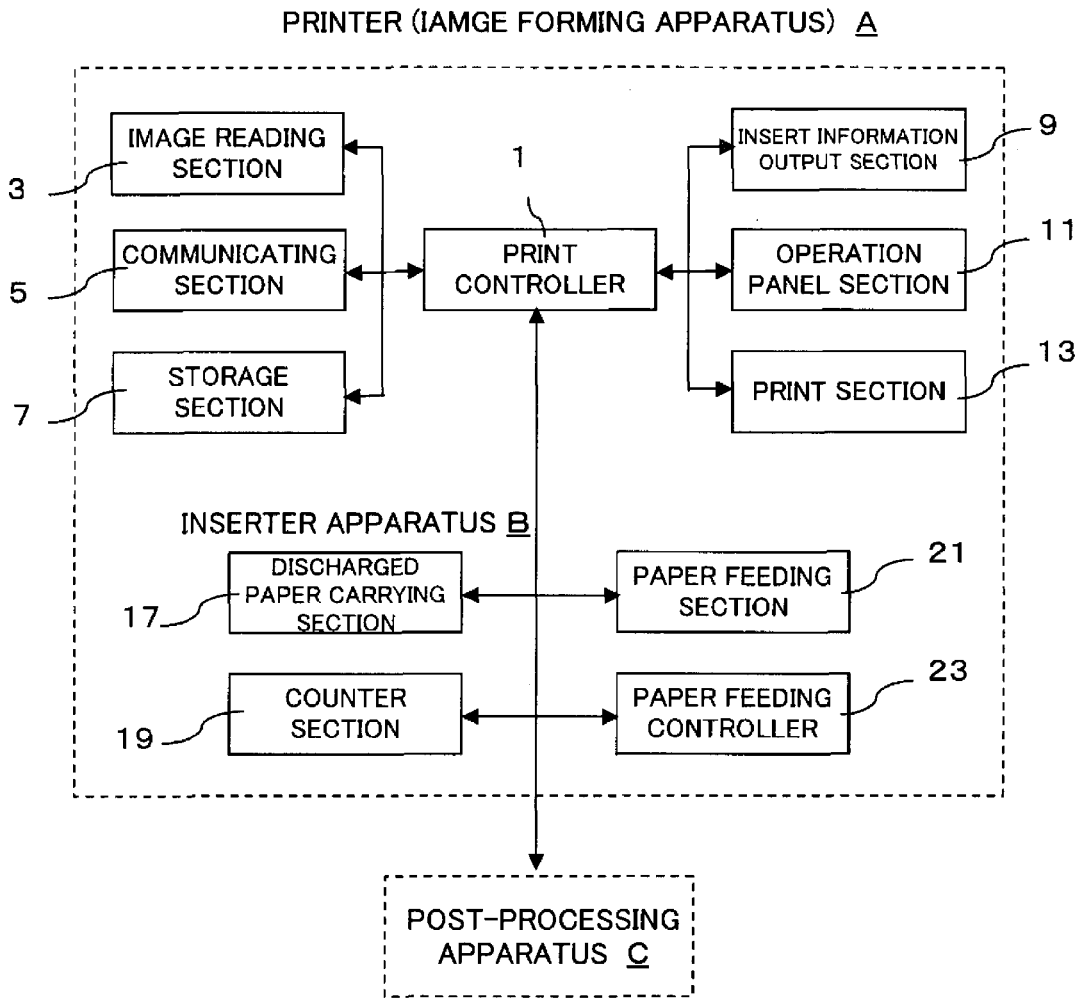
FIG. 5 is an outlined block diagram illustrating other embodiment of the printer according to the present invention.

Further, as shown in FIG. 5, the printer A may have the aforementioned inserter apparatus B built-in, so as to have an insert function. Similarly, the printer A has an advantage of improving the insert processing efficiency. Each constituent element of FIG. 5 is the same as that of FIG. 1.

Then, in the present invention, a position for disposing the counter section 19 is not necessarily limited to the discharged paper carrying section 17, and may be, for example, an input section side of the post-processing apparatus C or a discharged paper section side of the printer A.

Note that the paper used in executing the present invention is not limited to a paper medium and the present invention can be executed by other print medium such as a synthetic-resin sheet.

What is claimed is:

1. An inserter apparatus, comprising:

a discharged paper carrying section that carries printing papers discharged from a print section side;

a counter section that counts the number of sheets of said printing papers carried on a carrying path of this discharged paper carrying section;

a paper feeding section in which an insert paper is set, said insert paper being inserted on said printing papers carried on the carrying path of said discharged paper carrying section; and a paper feeding controller that controls said paper feeding section to feed said insert paper based on an insert page and a paper interval of said adjacent printing papers instructed from said print section side, before the paper interval that comes next is passed by a period required for feeding and inserting said insert paper, when a count value of said counter section reaches one page before said insert page.

2. The inserter apparatus according to claim 1, wherein said discharged paper carrying section carries said printing paper, with a space of pages provided for inserting said insert paper.

3. The inserter apparatus according to claim 1, wherein said counter section starts to count based on print start information of said print section side.

4. The inserter apparatus according to claim 1, wherein said discharged paper carrying section is disposed in a front stage of a post-processing apparatus.

* * * * *